US011161723B2

(12) United States Patent
Honjo

(10) Patent No.: US 11,161,723 B2
(45) Date of Patent: Nov. 2, 2021

(54) CRANE WINCH DEVICE AND CRANE

(71) Applicant: SUMITOMO HEAVY INDUSTRIES CONSTRUCTION CRANES CO., LTD., Tokyo (JP)

(72) Inventor: Kohei Honjo, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 36 days.

(21) Appl. No.: 16/806,559

(22) Filed: Mar. 2, 2020

(65) Prior Publication Data

US 2020/0283274 A1 Sep. 10, 2020

(30) Foreign Application Priority Data

Mar. 4, 2019 (JP) ..... JP2019-038903

(51) Int. Cl.
*B66D 1/44* (2006.01)
*B66D 1/16* (2006.01)
*B66D 1/08* (2006.01)

(52) U.S. Cl.
CPC ..... *B66D 1/44* (2013.01); *B66D 1/08* (2013.01); *B66D 1/16* (2013.01)

(58) Field of Classification Search
CPC ... B66D 1/44; B66D 1/08; B66D 1/16; B66D 1/225; B66D 5/08; B66D 5/14; B66C 13/20
See application file for complete search history.

(56) References Cited

FOREIGN PATENT DOCUMENTS

| | | | | | |
|---|---|---|---|---|---|
| CN | 201447327 | U | | 5/2010 | |
| GB | 1439624 | A | * | 6/1976 | ..... B66D 1/08 |
| JP | 3589051 | B2 | | 8/2004 | |
| JP | 3292578 | B2 | | 6/2006 | |
| JP | 2007131454 | A | * | 5/2007 | ..... B66D 1/44 |
| JP | 2008189437 | A | * | 8/2008 | ..... B66D 5/26 |
| JP | 201225522 | A | * | 2/2012 | ..... B66D 5/26 |
| TW | 370105 | U | | 9/1999 | |

OTHER PUBLICATIONS

Office Action issued in Taiwanese Application No. 10920868280, dated Sep. 9, 2020.

* cited by examiner

*Primary Examiner* — Emmanuel M Marcelo
(74) *Attorney, Agent, or Firm* — Michael Best & Friedrich LLP

(57) ABSTRACT

There is provided a crane winch device allowing a suspended load to freely fall due to a load thereof. The crane winch device includes a winch drum around which a rope for suspending the suspended load is wound, braking brake unit that brakes the winch drum, speed-increasing unit that performs speed-increasing assist of the winch drum in a direction of free fall acceleration when a braking force of the brake unit is smaller than a first threshold, and an adjustment unit that adjusts the first threshold.

11 Claims, 8 Drawing Sheets

| SETTING | FIRST THRESHOLD | SECOND THRESHOLD |
|---|---|---|
| SETTING 1 | 20% | 24% |
| SETTING 2 | 30% | 36% |
| SETTING 3 | 40% | 48% |

FIG. 10

| LOAD \ TEMPERATURE | $T_1$ | $T_2$ | $T_3$ | ..... |
|---|---|---|---|---|
| $P_1$ | 40% | 30% | 20% | ..... |
| $P_2$ | 35% | 25% | 15% | ..... |
| $P_3$ | 30% | 20% | 10% | ..... |
| : | : | : | : | : |

CRANE WINCH DEVICE AND CRANE

RELATED APPLICATIONS

The content of Japanese Patent Application No. 2019-038903, on the basis of which priority benefits are claimed in an accompanying application data sheet, is in its entirety incorporated here by reference.

BACKGROUND

Technical Field

Certain embodiments of the present invention relate to a crane winch device and a crane.

Description of Related Art

In the related art, a winch device is known which has a free fall function to rotate a winch drum in a rope delivery direction by using a weight of a suspended load. However, when the weight of the suspended load is excessively light, in some cases, the suspended load may not smoothly and freely fall since the winch device is affected by viscous resistance of oil filling a braking device.

Therefore, the related art discloses a technique for speed-increasing assist in free fall of the suspended load as follows. When a clutch pressure is equal to or smaller than a predetermined threshold so that the suspended load having a light weight smoothly and freely falls, a hydraulic motor is rotationally driven in the rope delivery direction.

SUMMARY

According to an embodiment of the present invention, there is provided a crane winch device allowing a suspended load to freely fall due to a load thereof. The crane winch device includes a winch drum around which a rope for suspending the suspended load is wound, a brake unit that brakes the winch drum, speed-increasing unit that performs speed-increasing assist of the winch drum in a direction of free fall acceleration when a braking force of the brake is smaller than a first threshold, and an adjustment unit that adjusts the first threshold.

BRIEF DESCRIPTION OF THE DRAWINGS

FIG. 10 is a view illustrating a correspondence between a load, a temperature, and the first threshold.

DETAILED DESCRIPTION

However, a winch disclosed in the related art has the following disadvantage. A clutch pressure is a fixed value when speed-increasing assist starts. Consequently, a falling speed of the suspended load deviates from an image of an operator, thereby impairing workability.

It is desirable to provide a crane winch device capable of starting speed-increasing assist in free fall at a proper timing, and a crane including the crane winch device.

According to the present invention, a first threshold is variable. Therefore, it is possible to start speed-increasing assist in free fall at a proper timing. Tasks, configurations, and advantageous effects other than those described above will be clarified in the following description of embodiments.

One Embodiment

Figure 1:
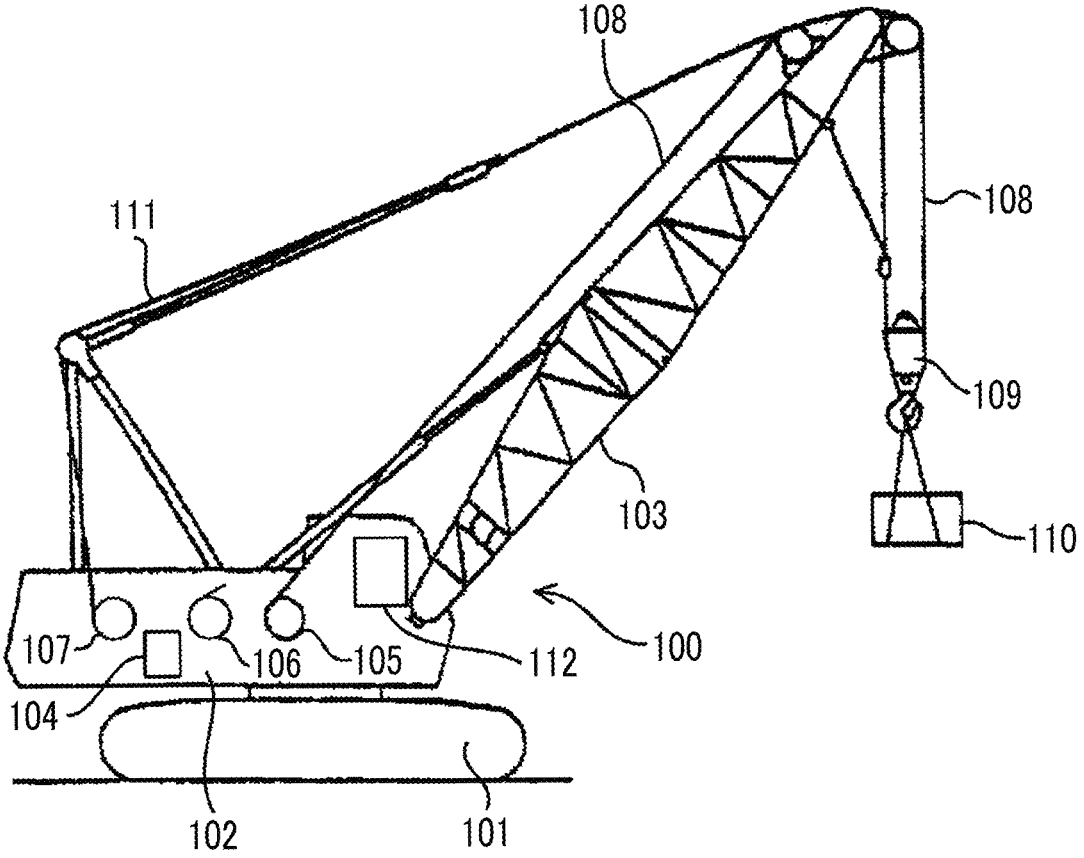
FIG. 1 is a side view of a crawler crane according to one embodiment.

Hereinafter, one embodiment according to the present invention will be described with reference to the drawings. FIG. 1 is a side view of a crawler crane 100 which is a representative example of a crane.

As illustrated in FIG. 1, the crane 100 has an undercarriage 101 having a pair of crawlers, a turning body 102 turnably mounted on the undercarriage 101, and a boom 103 supported by the turning body 102 so that a derricking operation can be performed. An engine 104 serving as a power source of the crane 100 and three winch devices (front winch 105, rear winch 106, and boom derricking winch 107) are mounted on the turning body 102.

The front winch 105 rotates in a winding or unwinding direction of main wire rope (rope) 108. In this manner, a suspended load 110 suspended by a main hook 109 is raised and lowered. The rear winch 106 rotates in a winding or unwinding direction of an auxiliary wire rope (not illustrated). In this manner, the suspended load 110 suspended by an auxiliary hook (not illustrated) is raised and lowered. The boom derricking winch 107 rotates in a winding or unwinding direction of a boom derricking rope 111. In this manner, the boom 103 performs a derricking operation.

The turning body 102 has a cab 112. An operation device (operation unit) that receives an operation of an operator for operating the crane 100 is installed in the cab 112. The operation device outputs an operation signal corresponding to the operation of the operator to a controller 60 (refer to FIG. 2, to be described later).

That is, the operator riding on the cab 112 operates the operation device. Accordingly, the undercarriage 101 travels, the turning body 102 turns, the boom 103 performs the derricking operation, and the winch devices 105 to 107 are rotationally driven. A specific configuration of the operation device is not particularly limited. However, for example, a steering wheel, a lever, a pedal, and a switch correspond to the operation device.

Figure 2:
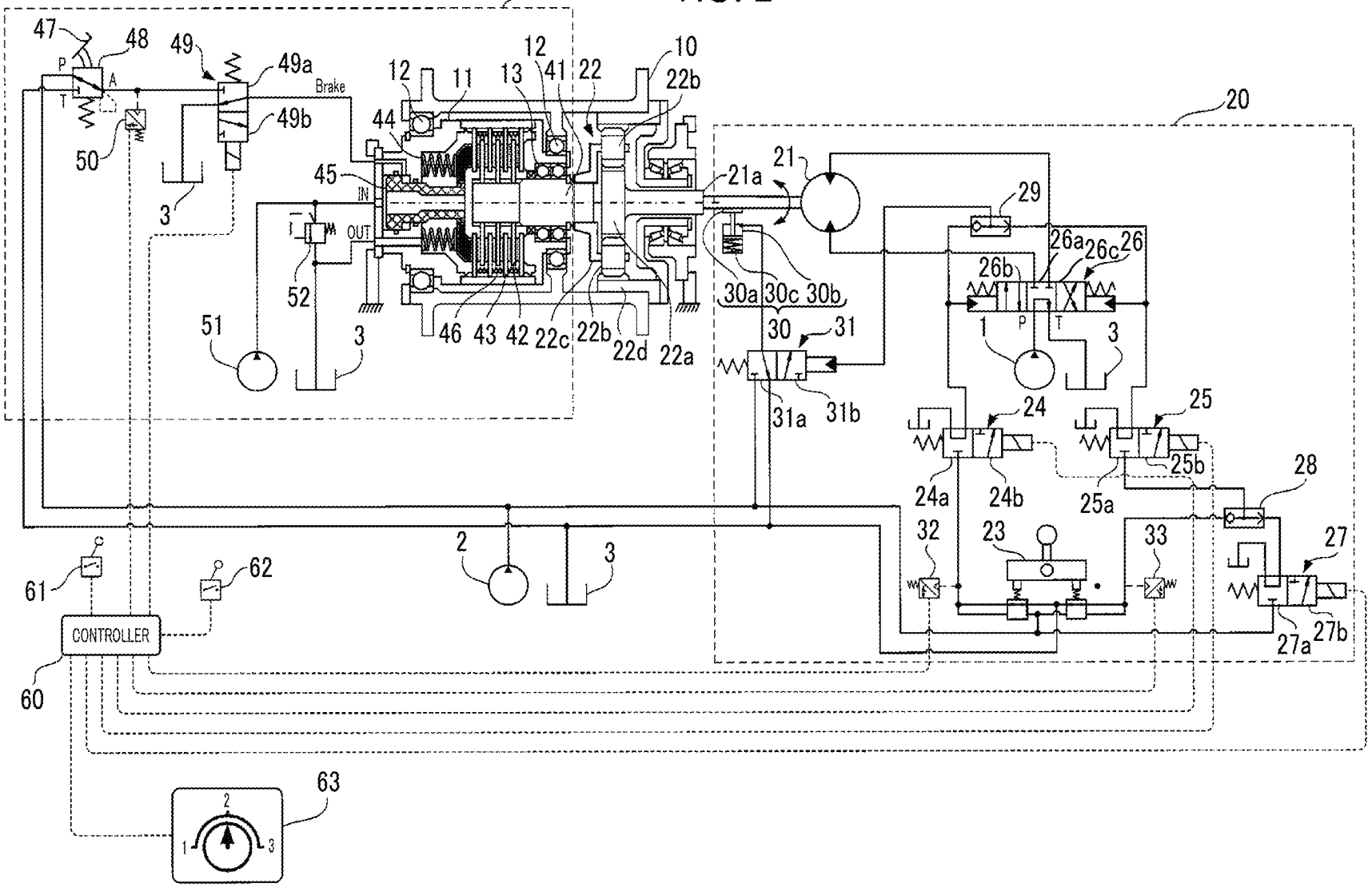
FIG. 2 is a view illustrating a drive circuit of a winch device according to the embodiment.

Next, details of the front winch 105 will be described with reference to FIG. 2. FIG. 2 is a view illustrating a drive circuit of the front winch 105 according to the embodiment. The rear winch 106 can also adopt the same configuration as that in FIG. 2.

The front winch 105 mainly includes a winch drum 10, a drive device (driving unit, speed-increasing unit) 20 for driving the winch drum 10, and a braking device (brake unit) 40 for braking the winch drum 10. Each operation of the drive device 20 and the braking device 40 is controlled by the controller 60.

The winch drum 10 is a cylindrical member around which a main wire rope 108 is wound. The winch drum 10 is rotatably supported by an outer surface of the casing 11 via a bearing 12. More specifically, the winch drum 10 is supported by the casing 11 to be rotatable in a winding direction of the main wire rope 108 and in an unwinding direction of the main wire rope 108.

The drive device 20 rotationally drives the winch drum 10 in the winding direction and the unwinding direction of the main wire rope 108. The drive device 20 mainly includes a hydraulic motor 21, a planetary speed reducer 22, an operation lever 23, a winding switching valve 24, an unwinding switching valve 25, a direction switching valve 26, and an accelerating switching valve (second switching valve) 27, high pressure selection valves 28 and 29, a motor brake 30, a motor brake control valve 31, and hydraulic sensors 32 and 33.

The hydraulic motor 21 is rotated by hydraulic oil supplied from a main pump 1 through the direction switching valve 26. The rotation is transmitted to the winch drum 10, and the main wire rope 108 is rotationally driven in the winding direction and the unwinding direction. A rotation direction of the hydraulic motor 21 is controlled by a supply direction of the hydraulic oil, and a rotation speed of the hydraulic motor 21 is controlled by a supply amount (hydraulic pressure) of the hydraulic oil.

The planetary speed reducer 22 reduces the rotation speed of an output shaft 21*a* of the hydraulic motor 21, and transmits the rotation to the winch drum 10. The planetary speed reducer 22 mainly includes a sun gear 22*a* that rotates integrally with the output shaft 21*a*, a plurality of planetary gears 22*b* meshing with the sun gear 22*a*, a planetary carrier 22*c* that rotatably supports the plurality of planetary gears 22*b*, and a ring gear 22*d* meshing with the plurality of planetary gears 22*b*.

The planetary carrier 22*c* is connected to a shaft 41 of the braking device 40. Therefore, when the braking device 40 is in a braking mode (to be described later), the planetary carrier 22*c* allows rotation of the plurality of planetary gears 22*b*, and restricts revolution around the sun gear 22*a*. The ring gear 22*d* rotates integrally with the winch drum 10. As a result, the rotation speed of the output shaft 21*a* is reduced, and the rotation is transmitted to the winch drum 10.

The operation lever 23 is an operation device that receives an operation of an operator for controlling the rotation direction and the rotation speed of the winch drum 10 (in other words, the supply direction and hydraulic pressure of the hydraulic oil supplied to the hydraulic motor 21). The operation lever 23 is installed in the cab 112.

When the operation lever 23 is operated in the winding direction of the main wire rope 108 (hereinafter, referred to as a "winding operation"), the hydraulic oil supplied from a pilot pump 2 is output to the winding switching valve 24. On the other hand, when the operation lever 23 is operated in the unwinding direction of the main wire rope 108 (hereinafter, referred to as an "unwinding operation"), the hydraulic oil supplied from the pilot pump 2 is output to the unwinding switching valve 25. The amount (hydraulic pressure) of the hydraulic oil output from the operation lever 23 becomes larger (increases) as an operation amount of the operation lever 23 increases.

The winding switching valve 24 is disposed between the operation lever 23 and a winding side port of the direction switching valve 26. The winding switching valve 24 is an electromagnetic valve which can switch between a blocking position 24*a* for blocking a flow of the hydraulic oil from the operation lever 23 to the winding side port and a circulating position 24*b* for circulating the hydraulic oil from the operation lever 23 to the winding side port. An initial position of the winding switching valve 24 is the blocking position 24*a*. Then, when excited by the controller 60, the blocking position 24*a* is switched to the circulating position 24*b*.

The unwinding switching valve 25 is disposed between the operation lever 23 and the unwinding side port of the direction switching valve 26. The unwinding switching valve 25 is an electromagnetic valve which can switch between a blocking position 25*a* for blocking the flow of hydraulic oil from the operation lever 23 to the unwinding side port and a circulating position 25*b* for circulating the hydraulic oil from the operation lever 23 to the unwinding side port. The initial position of the unwinding switching valve 25 is the blocking position 25*a*. Then, when excited by the controller 60, the blocking position 25*a* is switched to the circulating position 25*b*.

The direction switching valve 26 controls the supply direction and supply amount (hydraulic pressure) of the hydraulic oil supplied from the main pump 1 to the hydraulic motor 21. The direction switching valve 26 is a proportional valve which can switch among a neutral position 26*a* at which the hydraulic oil is not supplied to the hydraulic motor 21, a winding position 26*b* at which the hydraulic oil directed in the winding direction of the main wire rope 108 is supplied to the hydraulic motor 21, and an unwinding position 26*c* at which the hydraulic oil directed in the unwinding direction of the main wire rope 108 is supplied to the hydraulic motor 21.

The initial position of the direction switching valve 26 is the neutral position 26*a*. Then, when the hydraulic oil is supplied from the winding switching valve 24 to the winding side port, the position is switched to the winding position 26*b*. When the hydraulic oil is supplied from the unwinding switching valve 25 to the unwinding side port, the position is switched to the unwinding position 26*c*. The amount (hydraulic pressure) of the hydraulic oil supplied from the direction switching valve 26 to the hydraulic motor 21 is adjusted by the amount (hydraulic pressure) of the hydraulic oil supplied to the winding side port and the unwinding side port.

The accelerating switching valve 27 outputs the hydraulic oil supplied from the pilot pump 2 to the unwinding switching valve 25. The accelerating switching valve 27 is an electromagnetic valve which can switch between a non-output position 27*a* at which the hydraulic oil is not output from the pilot pump 2 and an output position 27*b* at which the hydraulic oil is output from the pilot pump 2. The initial position of the accelerating switching valve 27 is the non-output position 27*a*. Then, when excited by the controller 60, the non-output position 27*a* is switched to the output position 27*b*. The amount (hydraulic pressure) of the hydraulic oil output from the accelerating switching valve 27 at the output position 27*b* is a predetermined fixed value.

The high pressure selection valve 28 supplies the hydraulic oil having a higher hydraulic pressure to the unwinding switching valve 25, out of the hydraulic oil output from the operation lever 23 to the unwinding switching valve 25 and the hydraulic oil output from the accelerating switching valve 27 to the unwinding switching valve 25. According to the control of the controller 60 (to be described later), when the operation lever 23 performs the unwinding operation, the high pressure selection valve 28 supplies the hydraulic oil output from the operation lever 23 to the unwinding switching valve 25. On the other hand, when the accelerating switching valve 27 is switched to the output position 27*b*, the high pressure selection valve 28 supplies the hydraulic oil output from the accelerating switching valve 27 to the unwinding switching valve 25.

The high pressure selection valve 29 supplies the hydraulic oil having the higher hydraulic pressure to the motor brake control valve 31, out of the hydraulic oil output from the winding switching valve 24 and the hydraulic oil output from the unwinding switching valve 25. Specifically, the high pressure selection valve 29 supplies the hydraulic oil output from the winding switching valve 24 to the motor brake control valve 31, when the operation lever 23 performs the winding operation. The high pressure selection valve 29 supplies the hydraulic oil output from the unwinding switching valve 25 to the motor brake control valve 31, when the operation lever 23 performs the unwinding operation. On the other hand, the high pressure selection valve 29 does not supply the hydraulic oil to the motor brake control valve 31, when the operation lever 23 is not operated (that is, when in a neutral state).

The motor brake 30 brakes the output shaft 21*a* of the hydraulic motor 21. The motor brake 30 includes a brake pad 30*a*, a cylinder 30*b*, and a coil spring 30*c*. When the hydraulic oil flows out from a rod chamber of the cylinder 30*b*, the brake pad 30*a* is brought into contact with the output shaft 21*a* by a biasing force of the coil spring 30*c*. In this manner, the output shaft 21*a* is braked. On the other hand, when the hydraulic oil is supplied to the rod chamber of the cylinder 30*b*, the brake pad 30*a* is separated from the output shaft 21*a* against the biasing force of the coil spring 30*c*. In this manner, the braking of the output shaft 21*a* is released.

The motor brake control valve 31 is a switching valve which can switch between a braking position 31*a* for returning the hydraulic oil in the rod chamber of the cylinder 30*b* to a tank 3 and a release position 31*b* for supplying the hydraulic oil from the pilot pump 2 to the rod chamber of the cylinder 30*b*. The initial position of the motor brake control valve 31 is the braking position 31*a*. Then, the motor brake control valve 31 switches from the braking position 31*a* to the release position 31*b* while receiving the supply of the hydraulic oil from the high pressure selection valve 29.

The hydraulic sensor 32 detects the hydraulic pressure of the hydraulic oil supplied from the operation lever 23 to the winding switching valve 24, and outputs a detection signal indicating a detection result to the controller 60. The hydraulic sensor 33 detects the hydraulic pressure of the hydraulic oil supplied from the operation lever 23 to the unwinding switching valve 25, and outputs a detection signal indicating a detection result to the controller 60.

When the winding operation of the operation lever 23 is detected, based on the detection signal of the hydraulic sensor 32, the controller 60 excites the winding switching valve 24. In this manner, the hydraulic motor 21 rotates in the winding direction of the main wire rope 108, and the braking of the output shaft 21*a* is released by the motor brake 30. On the other hand, when the stop of the winding operation of the operation lever 23 is detected, based on the detection signal of the hydraulic sensor 32, the controller 60 stops exciting the winding switching valve 24. In this manner, the rotation of the hydraulic motor 21 stops, and the motor brake 30 brakes the output shaft 21*a*.

When the unwinding operation of the operation lever 23 is detected, based on the detection signal of the hydraulic sensor 33, the controller 60 excites the unwinding switching valve 25. In this manner, the hydraulic motor 21 rotates in the unwinding direction of the main wire rope 108, and the braking of the output shaft 21*a* is released by the motor brake 30. On the other hand, when the stop of the unwinding operation of the operation lever 23 is detected, based on the detection signal of the hydraulic sensor 33, the controller 60 stops exciting the unwinding switching valve 25. In this manner, the rotation of the hydraulic motor 21 stops, and the motor brake 30 brakes the output shaft 21*a*.

A state of the braking device 40 is changed between a braking mode for restricting the free fall of the winch drum 10 and a free mode for allowing the free fall of the winch drum 10. The braking device 40 mainly includes a shaft 41, a stationary plate 42, a movable plate 43, a coil spring (biasing member) 44, a cylinder 45, a release spring 46, a brake pedal 47, a brake control valve 48, and a brake switching valve (first switching valve) 49, a hydraulic sensor (detector) 50, a cooling pump 51, and a pressure protection valve 52.

The shaft 41 is rotatably supported by an inner surface of the casing 11 via a bearing 13. The shaft 41 is connected to the planetary carrier 22*c* of the planetary speed reducer 22. When the braking device 40 is in the braking mode, the shaft 41 is not rotatable. Therefore, unless the hydraulic motor 21 rotates, the winch drum 10 does not rotate. On the other hand, when the braking device 40 is in the free mode, the shaft 41 is rotatable. Therefore, the winch drum 10 can rotate due to the weight of the suspended load 110.

The stationary plate 42 is a disc-shaped member that rotates integrally with the shaft 41. The movable plate 43 is a disc-shaped member disposed at a position facing the stationary plate 42 in an axial direction of the shaft 41. The movable plate 43 is supported by the casing 11 to be movable in the axial direction of the shaft 41. The coil spring 44 is supported by the casing 11, and biases the movable plate 43 in a direction in which the movable plate 43 comes into contact with the stationary plate 42.

The stationary plate 42 and the movable plate 43 are attached to a plurality of positions separated in the axial direction of the shaft 41. A groove (not illustrated) for circulating oil is formed on each surface of the stationary plate 42 and the movable plate 43. That is, the stationary plate 42 and the movable plate 43 configure a so-called wet brake.

The cylinder 45 receives the supply of the hydraulic oil from the brake switching valve 49, and is movable inside the casing 11 in the axial direction of the shaft 41. The cylinder 45 is connected to the movable plate 43. That is, the cylinder 45 is controlled by the brake switching valve 49, and the movable plate 43 is moved close to and away from the stationary plate 42.

Specifically, when the hydraulic oil flows out from the cylinder 45 to the tank 3, the movable plate 43 is brought into contact with the stationary plate 42 by a biasing force of the coil spring 44. In this manner, the shaft 41 is braked by a frictional force between the stationary plate 42 and the movable plate 43 which come into contact with each other. On the other hand, when the hydraulic oil is supplied from the brake switching valve 49 to the cylinder 45, the cylinder 45 separates the movable plate 43 from the stationary plate 42 against the biasing force of the coil spring 44. In this manner, the frictional force between the stationary plate 42 and the movable plate 43 gradually decreases, and the braking force of the shaft 41 is weakened.

The release spring 46 is disposed between the stationary plate 42 and movable plate 43 which are adjacent to each other. The release spring 46 has a role to separate the stationary plate 42 and the movable plate 43 which are adjacent to each other, in a state where the hydraulic oil is supplied to the cylinder 45. That is, the biasing force of the release spring 46 is set to be smaller than that of the coil spring 44.

Figures 3, 4:
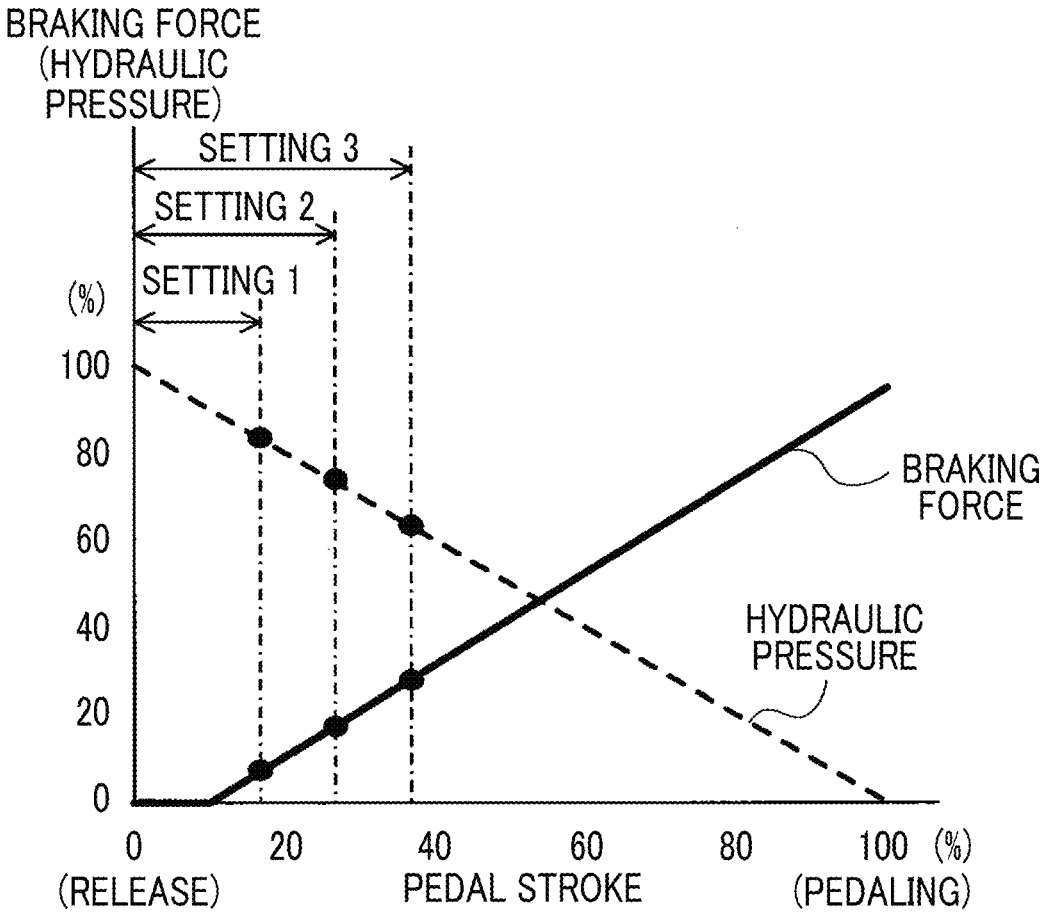
FIG. 3 is a view illustrating a table of a first threshold and a second threshold.
FIG. 4 is a view illustrating a relationship between a pushed amount of a brake pedal and a braking force of a braking device.

The brake pedal 47 is an operation device (braking operation unit) that receives an operation of an operator for increasing or decreasing the braking force of the braking device 40. FIG. 4 is a view illustrating a relationship between a pushed amount of the brake pedal 47 and the braking force of the braking device 40. As illustrated in FIG. 4, as the pushed amount of the brake pedal 47 increases, the braking force of the braking device 40 increases. On the other hand, when the pushed amount of the brake pedal 47 decreases, the braking force of the braking device 40 decreases.

The brake control valve 48 receives the supply of the hydraulic oil from the pilot pump 2, and outputs the hydraulic oil having the amount (hydraulic pressure) corresponding to the pushed amount of the brake pedal 47, to the brake switching valve 49. As illustrated in FIG. 4, the hydraulic pressure of the hydraulic oil output from the brake control valve 48 decreases as the pushed amount of the brake pedal 47 increases, and increases as the pushed amount of the brake pedal 47 decreases.

The brake switching valve 49 is disposed between the brake control valve 48 and the cylinder 45. The brake switching valve 49 is an electromagnetic valve which can switch between an outflow position 49*a* at which the hydraulic oil inside the cylinder 45 flows out to the tank 3 and a supply position 49*b* at which the hydraulic oil output from the brake control valve 48 is supplied to the cylinder 45.

The initial position of the brake switching valve 49 is the outflow position 49*a*. Then, when excited by the controller 60, the outflow position 49*a* is switched to the supply position 49*b*. That is, the braking device 40 is a negative brake in which the braking force is released only while the brake switching valve 49 is excited by the controller 60.

The hydraulic sensor 50 detects the hydraulic pressure of the hydraulic oil output from the brake control valve 48, and outputs a detection signal indicating a detection result to the controller 60. As illustrated in FIG. 4, the braking force of the braking device 40 decreases as the hydraulic pressure of the hydraulic oil output from the brake control valve 48 increases, and increases as the hydraulic pressure of the hydraulic oil decreases. That is, the hydraulic sensor 50 functions as detector that detects the braking force of the braking device 40.

However, a specific example of the detector is not limited to the hydraulic sensor 50, and may have other configurations capable of detecting a value relating to the braking force. As another example, the detector may detect the pushed amount of the brake pedal, or may detect a movement amount of the movable plate 43.

The cooling pump 51 supplies cooling oil between the stationary plate 42 and the movable plate 43 through an IN-port disposed in the casing 11. The cooling oil cools the stationary plate 42 and the movable plate 43 after passing through the stationary plate 42 and the movable plate 43 and through grooves disposed therein, and flows out from the casing 11 through an OUT port. The pressure protection valve 52 controls the pressure of the cooling oil so that an internal pressure of the cooling oil inside the casing 11 is equal to or lower than a withstand pressure of an oil seal.

The cab 112 has a brake mode change-over switch 61. The brake mode change-over switch 61 is an operation device that receives an operation of an operator for switching a position of the brake switching valve 49. The brake mode change-over switch 61 is an alternate switch that can switch between a first state corresponding to the outflow position 49*a* and a second state corresponding to the supply position 49*b*.

When the brake mode change-over switch 61 is in the first state, the controller 60 does not excite the brake switching valve 49. In this manner, the braking device 40 is brought into the braking mode. On the other hand, when the brake mode change-over switch 61 is in the second state, the controller 60 excites the brake switching valve 49. In this manner, the braking device 40 is brought into the free mode.

The cab 112 has an accelerating change-over switch 62. The accelerating change-over switch 62 is an operation device that receives an operation of an operator who designates whether or not the drive device 20 performs the speed-increasing assist in the free fall of the winch drum 10. The accelerating change-over switch 62 is an alternate switch that can switch between an ON-state corresponding to speed-increasing assist in the free fall and an OFF-state corresponding to non-speed-increasing assist in the free fall.

Furthermore, the cab 112 has an adjustment volume 63. The adjustment volume 63 receives an operation of an operator who designates timing for starting the speed-increasing assist in the free fall. Specifically, the adjustment volume 63 receives designation of a numerical value indicating the braking force of the braking device 40.

The adjustment volume 63 according to the embodiment is a rotary switch that receives an operation of an operator who designates one of three discrete settings. As illustrated in FIG. 3, the storage device stores a first threshold and a second threshold which respectively correspond to the three settings that can be designated by the adjustment volume 63. FIG. 3 is a view illustrating a table of the first threshold and the second threshold which correspond to each setting.

As illustrated in FIG. 3, the different first threshold and second threshold are associated with Settings 1 to 3. The first threshold indicates the braking force when the speed-increasing assist starts. The second threshold indicates the braking force when the speed-increasing assist is stopped. That is, an operator can adjust timing for starting and stopping the speed-increasing assist by operating the adjustment volume 63.

In a case where the braking force when the brake pedal 47 is not pushed is defined as 0% and the braking force when the brake pedal 47 is pushed to the maximum is defined as 100%, the first threshold and the second threshold according to the embodiment are expressed by a ratio of the braking forces when starting or stopping the speed-increasing assist.

In an example illustrated in FIG. 3, a value obtained by multiplying the first threshold by a constant $\alpha$ (for example, 1.2) is set as the second threshold. That is, the second threshold indicates the braking force greater than the first threshold. Although details will be described later with reference to FIG. 5, a dead zone exists between the first threshold and the second threshold. However, a method of calculating the second threshold is not limited to the above-described example.

The controller 60 acquires the operation signal output from the operation device and the detection signal output from the hydraulic sensors 32, 33, and 50, and controls the hydraulic pumps 1, 2, and 51, the winding switching valve 24, the unwinding switching valve 25, the accelerating switching valve 27, and the brake switching valve 49. Specific control contents of the controller 60 will be described later with reference to FIG. 5.

The controller 60 includes a central processing unit (CPU), a read only memory (ROM), a random access memory (RAM), and a hard disc drive (HDD). Then, the CPU reads a program from the ROM, the RAM, and the HDD, and executes the program, thereby realizing a process (to be described later). The ROM, the RAM, and the HDD configure the storage device (storage unit).

However, a specific configuration of the controller 60 is not limited thereto, and may be realized by hardware such as an application specific integrated circuit (ASIC)) and a field-programmable gate array (FPGA).

Figure 5:
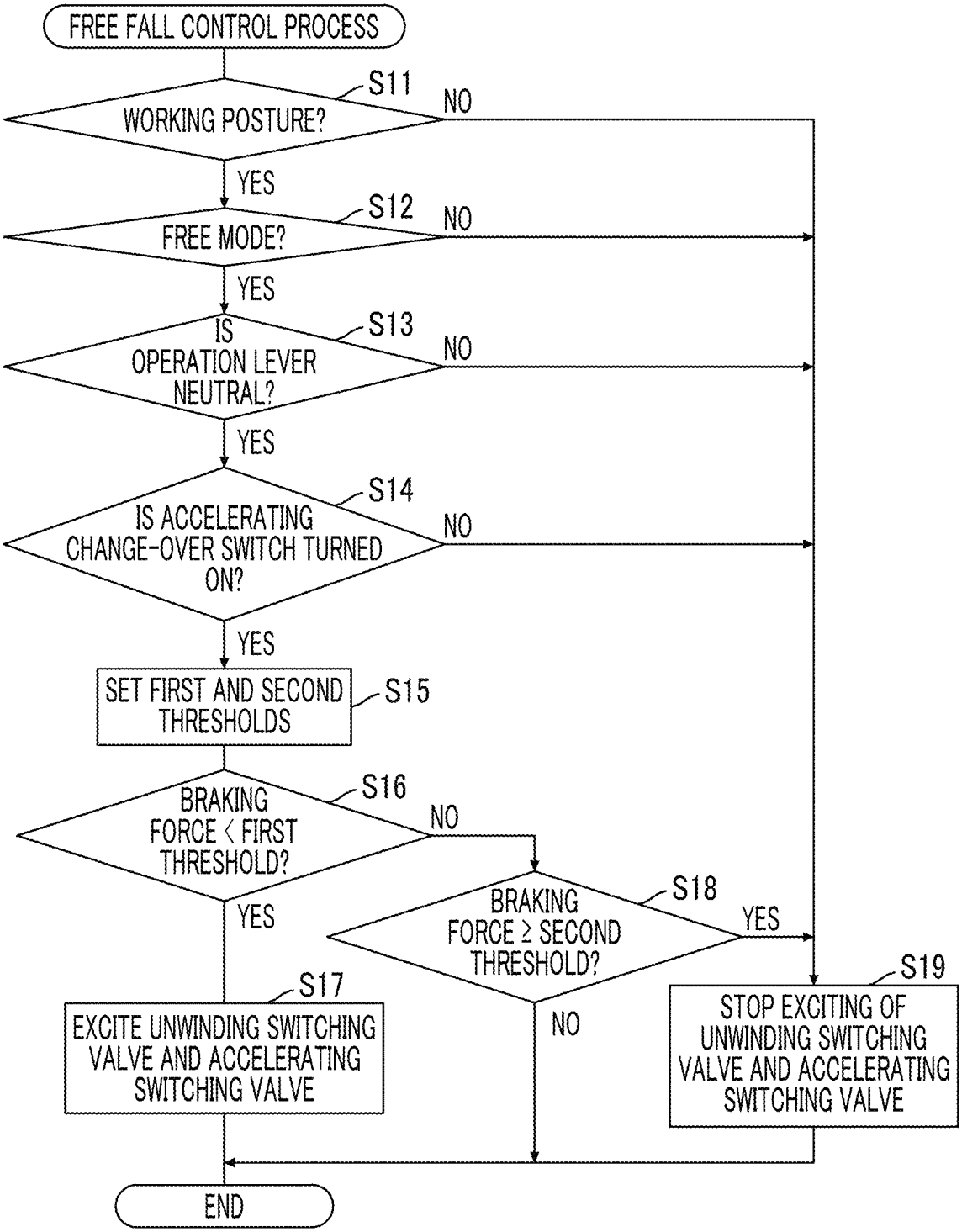
FIG. 5 is a flowchart of a free fall control process.

Next, a free fall control process performed by the controller 60 will be described with reference to FIG. 5. FIG. 5 is a flowchart of the free fall control process. For example, it is assumed that the controller 60 repeatedly performs the free fall control process illustrated in FIG. 5 while the engine 104 is driven.

First, the controller 60 determines whether or not the crawler crane 100 adopts a working posture (S11). For example, the working posture can be determined by a fact that an attachment (for example, the main hook 109) is attached to the main wire rope 108, or a fact that a derricking angle of the boom 103 is equal to or larger than a predetermined minimum angle. The controller 60 may determine whether or not the crawler crane 100 adopts the working posture, based on a detection result of a known sensor included in the crawler crane 100.

Next, when it is determined that the crawler crane 100 adopts the working posture (S11: YES), the controller 60 determines whether or not the braking device 40 is in the free mode (S12). For example, the controller 60 may determine whether or not the braking device 40 is in the free mode by referring to an internal flag stored in the RAM.

The mode is switched to the free mode when the brake mode change-over switch 61 is operated in the second state in a state where the crawler crane 100 adopts the working posture, a gate locking lever is released (state where a pilot hydraulic pressure is supplied), a free prohibition switch is cancelled, and the brake pedal is pushed. When the mode is switched from the braking mode to the free mode, the controller 60 raises an internal flag stored in the RAM. On the other hand, when the mode is switched from the free mode to the braking mode, the controller 60 lowers the internal flag.

Next, when the controller 60 determines that the braking device 40 is in the free mode, based on the internal flag (S12: YES), the controller 60 determines whether or not the operation lever 23 is in the neutral state (S13). That is, the controller 60 may determine whether or not the hydraulic oil is output from the operation lever 23, based on the detection signals of the hydraulic sensors 32 and 33.

Next, when the controller 60 determines that the operation lever 23 is in the neutral state (that is, the hydraulic oil is not output from the operation lever 23) (S13: YES), the controller 60 determines whether or not the accelerating change-over switch 62 is in the ON-state (S14).

Then, when the controller 60 determines that the accelerating change-over switch 62 is in the ON-state (S14: YES), the controller 60 reads the first threshold and the second threshold which correspond to the settings designated by an operator from the storage device through the adjustment volume 63 (S15).

As an example, in a case where Setting 2 is designated by the adjustment volume 63, the first threshold is 30% and the second threshold is 36%. That is, the controller 60 functions as an adjustment unit that adjusts the first threshold and the second threshold in accordance with an operation of the operator which is performed on the adjustment volume 63.

Next, the controller 60 compares the braking force of the braking device 40 with the first threshold set in Step S15 (S16). For example, the braking force of the braking device 40 is specified by the hydraulic pressure measured by the hydraulic sensor 50. When the controller 60 determines that the braking force of the braking device 40 is smaller than the first threshold (S16: YES), the controller 60 excites the unwinding switching valve 25 and the accelerating switching valve 27 (S17).

In this manner, the hydraulic motor 21 rotates in the unwinding direction of the main wire rope 108, and the braking of the output shaft 21*a* is released by the motor brake 30. As a result, the speed-increasing assist in the free fall of the suspended load 110 is performed by the drive device 20.

Here, the braking device 40 is in the free mode. Accordingly, the rotation of the shaft 41 is allowed. Therefore, the planetary gear 22*b* can revolve in response to the rotation of the sun gear 22*a*. However, the rotation of the shaft 41 receives considerable resistance due to viscous resistance of the cooling oil between the stationary plate 42 and the movable plate 43. Therefore, most of the rotational driving force of the sun gear 22*a* is transmitted to the winch drum 10.

On the other hand, when the controller 60 determines that the braking force of the braking device 40 is equal to or greater than the first threshold (S16: NO), the controller 60 compares the braking force of the braking device 40 with the second threshold set in Step S15 (S18). When the controller 60 determines that the braking force of the braking device 40 is equal to or greater than the second threshold (S18: YES), the controller 60 stops exciting the unwinding switching valve 25 and the accelerating switching valve 27 (S19). In this manner, the speed-increasing assist in the free fall is stopped by the drive device 20.

In a case where the controller 60 determines that the crawler crane 100 does not adopt the working posture (S11: NO), in a case where the controller 60 determines that the braking device 40 is not in the free mode (S12: NO), in a case where the controller 60 determines that the operation lever 23 is not in the neutral state (S13: NO), and in a case where the controller 60 determines that the accelerating change-over switch is not in the ON-state (S14: NO), exciting the unwinding switching valve 25 and the speed-increasing switching valve 27 is also stopped (S19).

On the other hand, when the controller 60 determines that the braking force of the braking device 40 is equal to or greater than the first threshold and is smaller than the second threshold (S18: NO), the processes in Steps S17 and S19 are not performed. That is, when the unwinding switching valve 25 and the accelerating switching valve 27 are excited, both of these are continuously excited without any change. On the other hand, when the unwinding switching valve 25 and the accelerating switching valve 27 are not excited, the exciting is continuously stopped without any change.

According to the embodiment, for example, the following operational effect can be achieved.

In the crawler crane 100 according to the embodiment, in a state where the brake pedal 47 is pushed, the operator who wants the free fall of the suspended load 110 brings the brake mode change-over switch 61 into the second state, and brings the accelerating change-over switch 62 into the ON-state. Then, the operator gradually releases the brake pedal 47.

Here, when the weight of the suspended load 110 is sufficiently heavy, the suspended load 110 starts the free fall against the viscous resistance of the cooling oil, before the braking force of the braking device 40 is smaller than the first threshold. Therefore, the operator may finely adjust the pushed amount of the brake pedal 47 to adjust the falling speed of the suspended load 110.

On the other hand, when the weight of the suspended load 110 is light, the free fall of the suspended load 110 does not easily start due to the viscous resistance of the cooling oil. Therefore, when the braking force of the braking device 40 is smaller than the first threshold (S16: YES), the controller 60 causes the drive device 20 to start the speed-increasing assist (S17). In this manner, even the suspended load 110 whose weight is light can smoothly and freely fall.

Here, when the timing for starting the speed-increasing assist is too late, working efficiency is degraded. On the other hand, when the timing for starting the speed-increasing assist is too early, there is a possibility that the suspended load 110 may fall more than necessary. Therefore, it is desirable that the timing for starting the speed-increasing assist can be changed depending on the weight of the suspended load 110 or a skill level of the operator.

Therefore, the front winch 105 according to the embodiment is configured so that the first threshold and the second threshold can be adjusted by the operator through the adjustment volume 63. In this manner, the speed-increasing assist starts at the timing close to an image of the operator, thereby improving workability.

In the embodiment, the speed-increasing assist is stopped when triggered by the braking force of the braking device 40 reaching the second threshold during the speed-increasing assist in the free fall. In other words, after the speed-increasing assist starts when the braking force of the braking device 40 is smaller than the first threshold, the speed-increasing assist is continuously performed until the braking force of the braking device 40 reaches the second threshold.

In this way, a range between the first threshold and the second threshold is set as the dead zone. Accordingly, when the braking force of the braking device 40 is finely adjusted around the first threshold, the speed-increasing assist repeatedly starts and stops. In this manner, it is possible to prevent the workability from being degraded. However, the second threshold may be omitted, and the speed-increasing assist may be controlled to start and stop, based on only the first threshold.

In the repeatedly performed free fall control process, the first threshold and the second threshold which correspond to the settings designated by the adjustment volume 63 are read every time. That is, the operator can adjust the first threshold and the second threshold in a state where the free fall is allowed. In this manner, a proper threshold can be selected while the falling speed of the suspended load 110 is observed.

For example, the state where the free fall is allowed indicates a state where the free fall is actually performed, or a state where the speed-increasing assist is performed. In other words, for example, the state where the free fall is allowed indicates a case where the brake mode change-over switch 61 is in the second state and the accelerating change-over switch 62 is in the ON-state.

Then, in a case where the first threshold is adjusted through the adjustment volume 63 during the free fall, the controller 60 may start the speed-increasing assist, based on the adjusted first threshold. On the other hand, in a case where the second threshold is adjusted through the adjustment volume 63 during the speed-increasing assist, the controller 60 may stop the speed-increasing assist, based on the adjusted second threshold. Even in this case, the second threshold is determined based on the first threshold. Accordingly, the speed-increasing assist is stopped, based on the first threshold. Furthermore, in a case where the second threshold is omitted, and in a case where the first threshold is adjusted through the adjustment volume 63 during the speed-increasing assist, the controller 60 may stop the speed-increasing assist, based on the adjusted first threshold. In this manner, the timing for starting and the timing for stopping the speed-increasing assist can be finely adjusted during the free fall or during the speed-increasing assist. Accordingly, operability is further improved.

According to the embodiment, when the operation lever 23 is operated during the speed-increasing assist (S13: NO), the speed-increasing assist is stopped (S19), and the rotation of the winch drum 10 is controlled in accordance with an operation amount of the operation lever 23. In this manner, the workability can be further improved by combining the free fall, and forcible winding and unwinding performed by the drive device 20.

The storage device may separately store a table for the front winch 105 and a table for the rear winch 106. The operation device may include the adjustment volume 63 for the front winch 105 and the adjustment volume 63 for the rear winch 106. Then, the controller 60 may individually adjust the first threshold and the second threshold for the front winch 105 and the first threshold and the second threshold for the rear winch 106.

Another Embodiment

Figure 6:
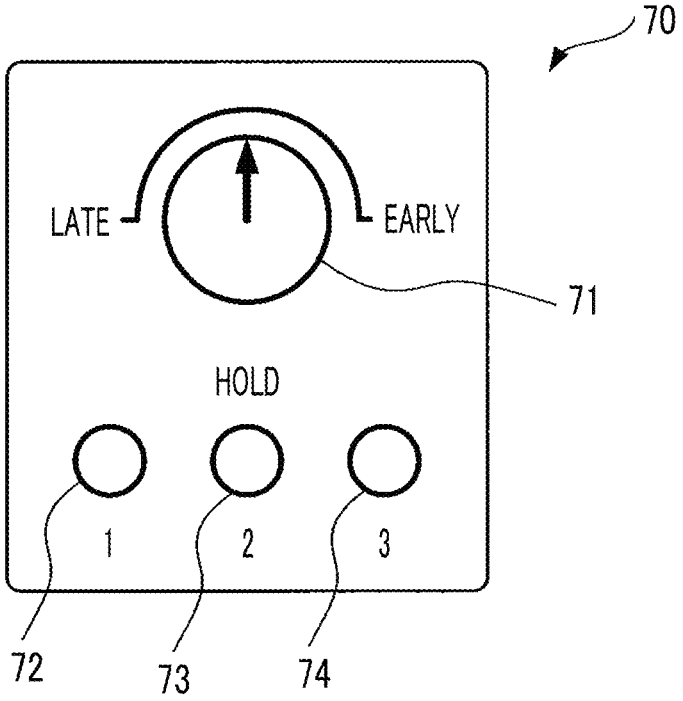
FIG. 6 is a view illustrating an adjustment panel according to another embodiment.
Figure 7:
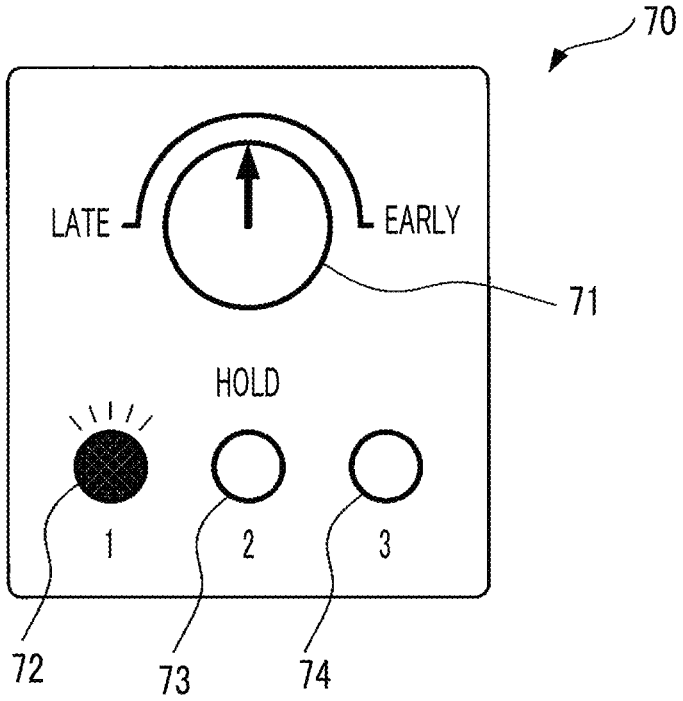
FIG. 7 is a view illustrating a state where one HOLD button is selected.
Figure 8:
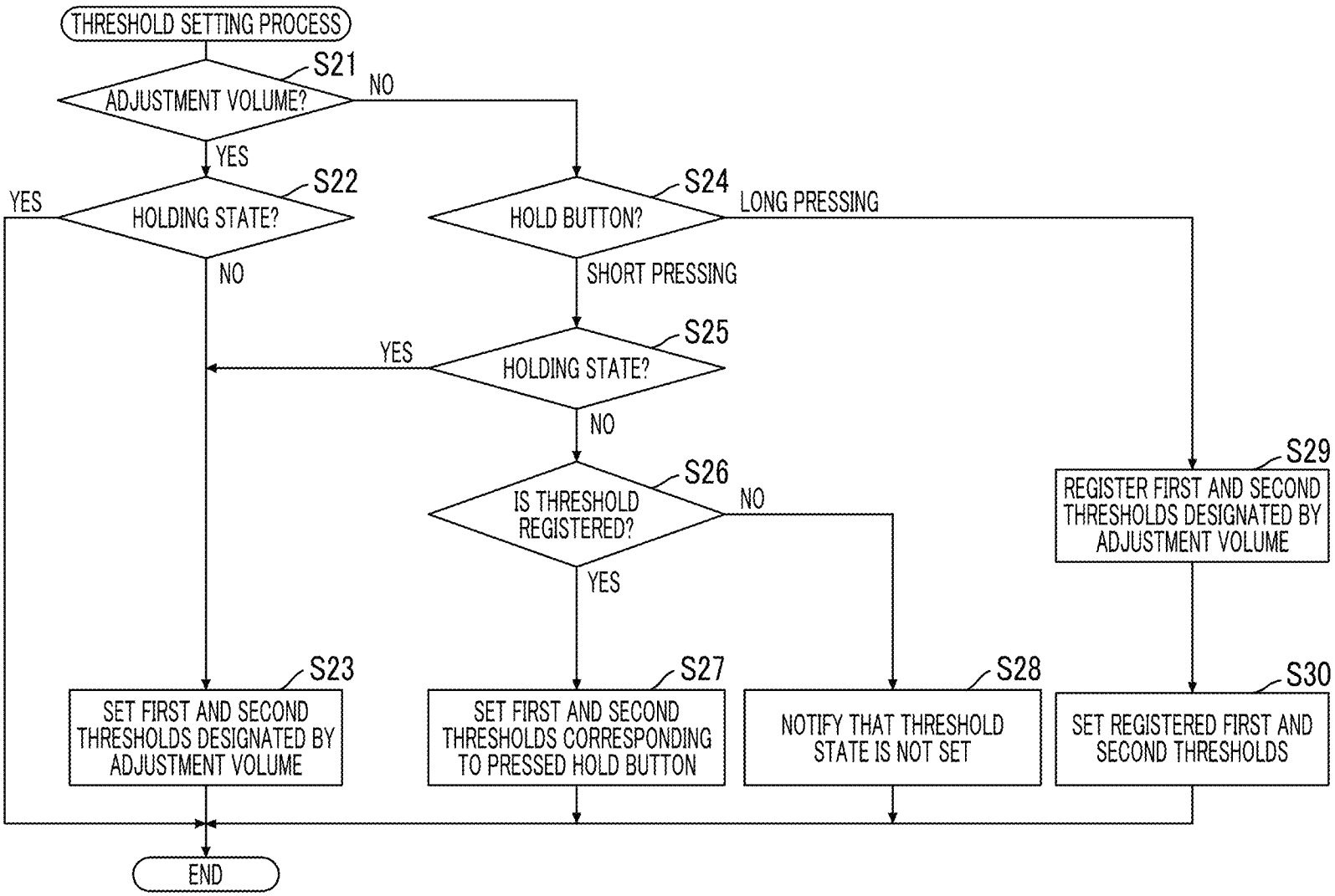
FIG. 8 is a flowchart of a threshold setting process.

A method of adjusting the first threshold and the second threshold by using the adjustment volume 63 is not limited to an example described above in the embodiment. Hereinafter, a method of adjusting the first threshold and the second threshold according to another embodiment will be described with reference to FIGS. 6 to 8. FIG. 6 is a view illustrating an adjustment panel 70 according to another embodiment. FIG. 7 is a view illustrating a state where a HOLD button 72 is selected. FIG. 8 is a flowchart of a threshold setting process.

Detailed description of points common to those according to the previous embodiment will be omitted, and different points will be mainly described. The crawler crane 100 according to another embodiment is different from that of the previous embodiment in that the crawler crane 100 includes the adjustment panel 70 instead of the adjustment volume 63, and other points are same as those of the previous embodiment.

The adjustment panel 70 is an operation device that receives an operation of an operator for adjusting the first threshold and the second threshold, and is installed in the cab 112. As illustrated in FIG. 6, the adjustment panel 70 mainly includes an adjustment volume 71 and a plurality of HOLD buttons (operation units) 72, 73, and 74.

The adjustment volume 71 is an alternate switch that receives the operation of the operator for designating a numerical value serving as the first threshold. However, the adjustment volume 71 according to another embodiment is different from the adjustment volume 63 according to the previous embodiment in that the numerical value serving as the first threshold can be designated in a non-step manner. That is, the adjustment volume 71 enables the operator to designate any desired numerical value from a continuous numerical value range (for example, 10% to 40%).

The HOLD buttons 72 to 74 have a role to fix the first threshold and the second threshold to numerical values registered in advance. The HOLD buttons 72 to 74 can receive a selection operation (for example, short pressing) for selecting the corresponding first threshold and second threshold and a registration operation (for example, long pressing) for registering the first threshold and the second threshold which are designated through the adjustment volume 71. The number of the HOLD buttons 72 to 74 is not limited to three, and may be one or more.

When the HOLD button 72 illustrated in FIG. 6 is pressed short, light is turned on as illustrated in FIG. 7 (hereinafter, a state of the HOLD button 72 illustrated in FIG. 7 will be referred to as a "HOLD state"). On the other hand, when the HOLD button 72 illustrated in FIG. 7 is pressed short, the light is turned off as illustrated in FIG. 6. That is, the HOLD state is released. When another HOLD button 73 is pressed short while the HOLD button 72 is in the HOLD state, the HOLD state of the HOLD button 72 is released, and the HOLD button 73 is newly brought into the HOLD state.

The storage device stores the first threshold and the second threshold which respectively correspond to the plurality of HOLD buttons 72 to 74. For example, Setting 1 in FIG. 3 corresponds to the HOLD button 72, Setting 2 corresponds to the HOLD button 73, and Setting 3 corresponds to the HOLD button 74. Before the threshold setting process is performed for the first time, it is assumed that each initial value of the first threshold and the second threshold is not set in a table illustrated in FIG. 3.

When the adjustment volume 71 is operated (S21: YES), the controller 60 according to another embodiment determines whether or not one of the HOLD buttons 72 to 74 is in the HOLD state (S22). When the controller 60 determines that all of the HOLD buttons 72 to 74 are not in the HOLD state (S22: NO), the controller 60 sets the numerical value designated through the adjustment volume 71 as the first threshold, and sets a value obtained by multiplying the first threshold by a constant $\alpha$ as the second threshold (S23). The first threshold and the second threshold which are set here are used for the free fall control process.

On the other hand, when the controller 60 determines that one of the HOLD buttons 72 to 74 is in the HOLD state (S22: YES), the controller 60 does not perform the process in Step S23. When one of the HOLD buttons 72 to 74 is in the HOLD state, as will be described later, the values are fixed to the first threshold and the second threshold which correspond to the HOLD buttons 72 to 74 in the HOLD state. Then, even if the adjustment volume 71 is operated in this state, the first threshold and the second threshold are not changed.

On the other hand, for example, when the controller 60 determines that the HOLD button 72 is pressed short (S24: short pressing), the controller 60 determines whether or not the HOLD button 72 is in the HOLD state (S25). Then, when the controller 60 determines that the HOLD button 72 pressed short is already in the HOLD state (S25: YES), the controller 60 releases the HOLD state of the HOLD button 72, and performs the process in Step S23.

When the controller 60 determines that the HOLD button 72 pressed short is not in the HOLD state (S25: NO), the controller 60 determines whether or not the first threshold and the second threshold which are associated with the HOLD button 72 are registered in the storage device (S26). Then, when the controller 60 determines that the first threshold and the second threshold which are associated with the HOLD button 72 are registered (S26: YES), the controller 60 sets the first threshold and the second threshold which are stored in the storage device in association with the HOLD button 72 as thresholds used for the free fall control process (S27). The controller 60 brings the HOLD button 72 into the HOLD state.

On the other hand, when the controller 60 determines that the first threshold and the second threshold which are associated with the HOLD button 72 are not registered (S26: NO), the controller 60 notifies the operator that the threshold is not set for the HOLD button 72 pressed short (S28). A notification method is not particularly limited. However, a message may be displayed on a display installed in the cab 112, or a guide voice may be output from a speaker. In this case, the HOLD button 72 is not brought into the HOLD state.

When the controller 60 determines that the HOLD button 72 is pressed long (S24: long pressing), the controller 60 registers a numerical value designated by the operator through the adjustment volume 71 in the storage device as the first threshold corresponding to the HOLD button 72, and registers a value obtained by multiplying the first threshold by the constant $\alpha$ in the storage device as the second threshold corresponding to the HOLD button 72 (S29). That is, the controller 60 functions as a registration unit that registers the numerical value designated by the operator through the adjustment volume 63 in the storage device as the first threshold and the second threshold which correspond to the HOLD button 72.

Furthermore, the controller 60 sets the first threshold and the second threshold which are stored in Step S29, as thresholds used for the free fall control process (S30). The controller 60 brings the HOLD button 72 into the HOLD state.

Then, in a case where the HOLD button 72 is in the HOLD state (S27 and S30), during the free fall control process illustrated in FIG. 5, the controller 60 controls to start and stop the speed-increasing assist, based on the first threshold and the second threshold which are stored in the storage device in association with the HOLD button 72.

According to another embodiment, for example, the following operational effect can be achieved.

According to another embodiment, the first threshold and the second threshold can be adjusted in the non-step manner by using the adjustment volume 71. Therefore, the speed-increasing assist can start and stop at the timing close to an image of the operator.

If the desired first threshold and second threshold are registered in advance in the HOLD buttons 72 to 74, the speed-increasing assist can start and stop at the desired timing, even without finely adjusting the adjustment volume 71 every time. Furthermore, the plurality of HOLD buttons 72 to 74 are provided. Therefore, a plurality of thresholds suitable for each operator or each weight of the suspended load 110 can be registered in advance.

A value stored as the new first threshold when the registration operation is performed on the HOLD buttons 72 to 74 is not limited to a numerical value designated by the operator through the adjustment volume 71. As another example, the controller 60 may calculate the new first threshold, based on a value other than the numerical value designated by the operator. As still another example, the controller 60 may adopt the new first threshold by using the braking force of the braking device 40 (that is, the hydraulic pressure measured by the hydraulic sensor 50) when the registration operation is performed.

The selection operation and the registration operation are not limited to the above-described example as long as different operations are performed on the same operation unit. As another example, the selection operation may be "long pressing", and the registration operation may "short pressing". As another example, one of the selection operation and the registration operation may be "pressing", and the other may be "pulling". As still another example, one of the selection operation and the registration operation may be "pressing once", and the other may be "pressing twice consecutively".

However, the selection operation and the registration operation may be performed on different operation units. The selection operation and the registration operation in this case may be the same operation or different operations. More specifically, the adjustment panel 70 may include a registration button for receiving a registration operation, separately from the HOLD button 72 for receiving the selection operation. A plurality of the registration buttons are provided in association with each of the plurality of HOLD buttons 72. Then, in a case where the controller 60 receives the registration operation for the registration button, the controller 60 may register the numerical value designated by the operator through the adjustment volume 71 in the storage device, as the first threshold of the corresponding HOLD button 72.

When the crawler crane 100 is delivered to a user, initial values of the first threshold and the second threshold which are respectively associated with the HOLD buttons 72 to 74 may be registered in the storage device. In this case, the processes in Steps S26 and S28 in FIG. 8 are omitted.

Still Another Embodiment

In the above-described embodiments, an example has been described in which the first threshold and the second threshold are adjusted based on the numerical value designated by the operator through the operation device. However, a method of adjusting the first threshold and the second threshold is not limited to the above-described example.

Figure 9:
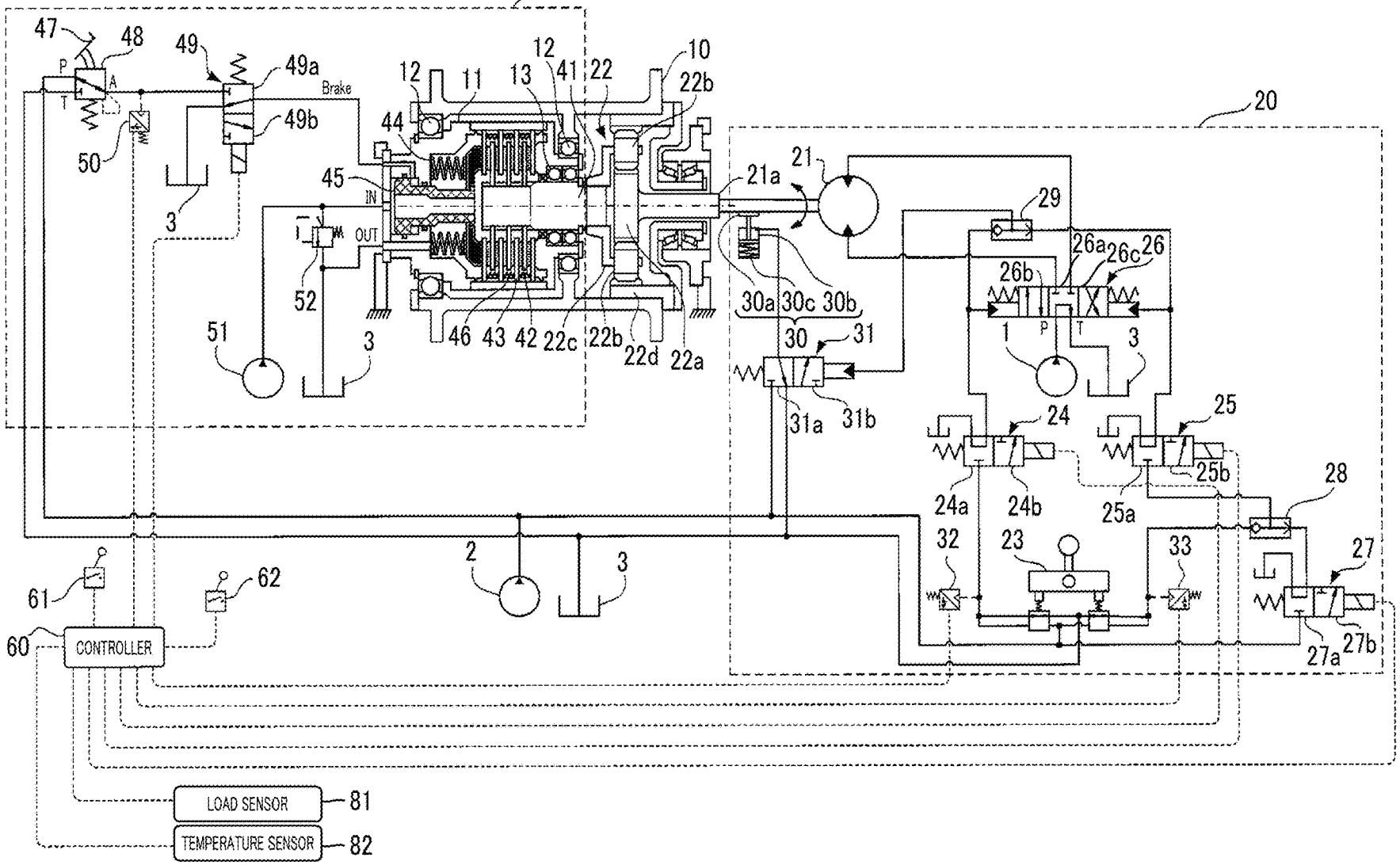
FIG. 9 is a view illustrating a drive circuit of a winch device according to still another embodiment.

Hereinafter, a method of adjusting the first threshold and the second threshold according to still another embodiment will be described with reference to FIGS. 9 and 10. FIG. 9 is a view illustrating a drive circuit of the front winch 105 according to still another embodiment. FIG. 10 is an example of a table showing a correspondence among a load P of the suspended load 110, a temperature T of the cooling oil, and the first threshold.

Detailed description of points common to those according to the previous embodiment will be omitted, and different points will be mainly described. The crawler crane 100 according to still another embodiment is different from that according to the above-described embodiment in that a load sensor 81 and a temperature sensor 82 are provided instead of the adjustment volume 63, and other points are common to those according to the above-described embodiment.

The load sensor 81 detects a load of the suspended load 110, and outputs a detection signal indicating a detection result to the controller 60. The temperature sensor 82 detects a temperature of the cooling oil that cools the stationary plate 42 and the movable plate 43, and outputs a detection signal indicating a detection result to the controller 60. For example, the temperature sensor 82 may detect the temperature of the cooling oil flowing out from an OUT port of the casing 11.

The storage device according to still another embodiment stores a table illustrated in FIG. 10. The table illustrated in FIG. 10 is a two-dimensional matrix showing the correspondence among the load P of the suspended load 110, the temperature T of the cooling oil, and the first threshold. In the table illustrated in FIG. 10, the first threshold is set in advance to increase as the load P decreases and the temperature T decreases. The second threshold is omitted in the illustration.

The controller 60 according to still another embodiment acquires the load P of the suspended load 110 which is measured by the load sensor 81 and the temperature T of the cooling oil which is measured by the temperature sensor 82 in Step S15 in FIG. 5. Then, the controller 60 reads the first threshold corresponding to the acquired load P and temperature T from the storage device. The controller 60 calculates the second threshold by multiplying the read first threshold by the constant $\alpha$.

According to still another embodiment, for example, the following operational effects can be achieved.

As the load of the suspended load 110 decreases or the viscosity of the cooling oil increases (for example, the temperature decreases), the suspended load 110 is less likely to freely fall. Therefore, as in still another embodiment, the first threshold and the second threshold which correspond to a combination between the load P and the temperature T are prepared in advance. The first threshold and the second threshold are automatically adjusted in accordance with the detection results of the load sensor 81 and the temperature sensor 82. In this manner, an operation burden on the operator is reduced.

The parameters for specifying the first threshold and the second threshold are not limited to the combination between the load P and the temperature T. As another example, the crawler crane 100 may include detector that detects viscosity V of the cooling oil instead of the temperature sensor 82. Then, the storage device may store the first threshold and the second threshold which correspond to the combination between the load P and the viscosity V.

Other Embodiments

In the above-described embodiments, an example has been described in which a ratio of the braking force of the braking device 40 is set to the first threshold and the second threshold. However, specific contents indicated by the first threshold and the second threshold are not limited to the above-described example.

As another example, the first threshold and the second threshold may indicate the hydraulic pressure measured by the hydraulic sensor 50. As still another example, in a case where the braking device 40 is an electric brake, the first threshold and the second threshold may be voltages applied to the braking device 40. The braking force of the braking device 40 decreases as the hydraulic pressure (voltage) increases. Therefore, in a case where the first threshold and the second threshold are the hydraulic pressure (voltage), the first threshold is greater than the second threshold (ratio of the braking force is smaller).

In this case, when the controller 60 determines in Step S16 that the hydraulic pressure measured by the hydraulic sensor 50 is equal to or greater than the first threshold, the controller 60 performs the process in Step S17. When the controller 60 determines in Step S18 that the hydraulic pressure measured by the hydraulic sensor 50 is smaller than the second threshold, the controller 60 performs the process in Step S19.

In the above-described embodiments, an example has been described in which the braking device 40 is a negative brake. However, the braking device 40 may be a positive brake whose braking force increases as the hydraulic pressure of the supplied hydraulic oil increases. In this case, when the controller 60 determines in Step S16 that the hydraulic pressure measured by the hydraulic sensor 50 is smaller than the first threshold, the controller 60 performs the process in Step S17. When the controller 60 determines in Step S18 that the hydraulic pressure measured by the hydraulic sensor 50 is equal to or greater than the second threshold, the controller 60 performs the process in Step S19.

In the above-described embodiments, an example has been described in which the speed-increasing assist in the free fall is performed using the drive device 20 that rotationally drives the winch drum 10 in accordance with the operation amount of the operation lever 23. However, an accelerating device (speed-increasing unit) for the speed-increasing assist in the free fall may be provided separately from the drive device 20.

The specific examples of the crane is not limited to the crawler crane 100, and may be a wheel crane, a rough terrain crane, an all terrain crane, an overhead crane, a tower crane, and a bridge crane.

Furthermore, the above-described embodiments may be implemented not only alone but also in any desired combination. For example, the above-described embodiments may be combined with each other. Other combinations can be adopted within the scope not departing from the gist of the present invention.

The present invention is not limited to the above-described embodiments. Various modifications can be made within the scope not departing from the gist of the present invention. All technical matters included in the technical idea disclosed in the appended claims aim to realize the present invention. The above-described embodiments are merely preferred examples. Those skilled in the art can realize various alternative examples, correction examples, modification examples, or improvement examples, based on the contents disclosed herein. These are included in the technical scope disclosed in the appended claims.

It should be understood that the invention is not limited to the above-described embodiment, but may be modified into various forms on the basis of the spirit of the invention. Additionally, the modifications are included in the scope of the invention.

What is claimed is:

1. A crane winch device allowing a suspended load to freely fall due to a load thereof, the device comprising:

a winch drum around which a rope for suspending the suspended load is wound;

a brake unit that brakes the winch drum;

a speed-increasing unit that performs speed-increasing assist of the winch drum in a direction of free fall acceleration when a braking force of the brake unit is smaller than a first threshold; and an adjustment unit that adjusts the first threshold.

2. The crane winch device according to claim 1, wherein the adjustment unit is capable of adjusting the first threshold in a non-step manner.

3. The crane winch device according to claim 1, wherein in a case where the first threshold is adjusted by the adjustment unit during the free fall, the speed-increasing unit starts the speed-increasing assist of the winch drum, based on the adjusted first threshold.

4. The crane winch device according to claim 1, wherein the speed-increasing unit stops the speed-increasing assist, in a case where the braking force of the brake unit reaches a second threshold greater than the first threshold during the speed-increasing assist of the winch drum.

5. The crane winch device according to claim 1, wherein the adjustment unit is capable of adjusting the first threshold, and wherein in a case where the first threshold is adjusted by the adjustment unit during the speed-increasing assist, the speed-increasing unit stops the speed-increasing assist of the winch drum, based on the adjusted first threshold.

6. The crane winch device according to claim 1, further comprising:

an operation unit that receives a selection operation by an operator; and a storage unit that stores the first threshold associated with the operation unit, wherein the speed-increasing unit controls starting and stopping the speed-increasing assist, based on the first threshold stored in the storage unit in association with the operation unit, in a case where the operation unit receives the selection operation.

7. The crane winch device according to claim 6, wherein a plurality of the operation units are provided, and wherein the storage unit stores a plurality of the first thresholds respectively associated with the plurality of operation units.

8. The crane winch device according to claim 6, further comprising:

a registration unit that causes the storage unit to store a new first threshold in association with the operation unit.

9. The crane winch device according to claim 8, wherein the registration unit causes the storage unit to store the new first threshold in association with the operation unit, in a case where the operation unit receives a registration operation different from the selection operation.

10. The crane winch device according to claim 1, wherein the brake unit includes a brake, a braking force of which increases as a hydraulic pressure of supplied hydraulic oil decreases, and a braking force of which decreases as the hydraulic pressure of the supplied hydraulic oil increases, a braking operation unit that receives an operation of an operator to increase or decrease the braking force of the brake, and a first switching valve capable of switching between an outflow position at which the hydraulic oil flows out from the brake and a supply position at which the hydraulic oil having a hydraulic pressure corresponding to the operation received by the braking operation unit is supplied to the brake, and wherein the speed-increasing unit includes a hydraulic motor that rotates the winch drum in a winding direction and an unwinding direction of the rope, and a second switching valve that is excited when the first switching valve is located at the supply position and the braking force of the brake unit is smaller than the first threshold, and that supplies the hydraulic oil to the hydraulic motor in the unwinding direction of the rope.

11. A crane comprising:

a plurality of the winch devices according to claim 1.

* * * * *